US006679328B2

(12) United States Patent
Davis et al.

(10) Patent No.: US 6,679,328 B2
(45) Date of Patent: Jan. 20, 2004

(54) REVERSE SECTION MILLING METHOD AND APPARATUS

(75) Inventors: John Phillip Davis, Cypress, TX (US); Gerald D. Lynde, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 10/123,077

(22) Filed: Apr. 11, 2002

(65) Prior Publication Data

US 2002/0162659 A1 Nov. 7, 2002

Related U.S. Application Data

(63) Continuation-in-part of application No. 09/619,131, filed on Jul. 18, 2000, now abandoned.

(60) Provisional application No. 60/145,638, filed on Jul. 27, 1999, and provisional application No. 60/338,458, filed on Nov. 30, 2001.

(51) Int. Cl.[7] ..... E21B 29/00; E21B 29/06

(52) U.S. Cl. ..... 166/298; 166/55.8; 166/361; 175/267

(58) Field of Search ..... 166/298, 361, 166/55, 55.7, 55.8, 98; 175/267, 286, 258, 406

(56) References Cited

U.S. PATENT DOCUMENTS

| | | | | |
|---|---|---|---|---|
| 1,611,281 A | | 12/1926 | Samuelson | |
| 2,124,663 A | | 7/1938 | Wintemute | |
| 2,203,011 A | | 6/1940 | Ellis et al. | |
| 2,482,674 A | * | 9/1949 | Kriegel | 166/55.8 |
| 3,126,065 A | | 3/1964 | Chadderdon | |
| 3,224,507 A | | 12/1965 | Cordary et al. | |
| 3,331,439 A | * | 7/1967 | Sanford | 166/55.8 |
| 3,419,077 A | | 12/1968 | Sanford | |
| 4,191,255 A | * | 3/1980 | Rives | 166/297 |
| 4,618,009 A | * | 10/1986 | Carter et al. | 175/267 |
| 4,776,394 A | * | 10/1988 | Lynde et al. | 166/55.8 |
| 4,893,675 A | | 1/1990 | Skipper | |
| 4,938,291 A | * | 7/1990 | Lynde et al. | 166/55.8 |
| 5,018,580 A | | 5/1991 | Skipper | |
| 5,139,098 A | | 8/1992 | Blake | |
| 5,242,017 A | * | 9/1993 | Hailey | 166/55.8 |
| 5,265,675 A | | 11/1993 | Hearn et al. | |
| 5,350,015 A | | 9/1994 | Hailey | |
| 5,385,205 A | * | 1/1995 | Hailey | 166/55.8 |
| 5,456,312 A | * | 10/1995 | Lynde et al. | 166/55.6 |
| 5,642,787 A | | 7/1997 | Hutchinson | |
| 5,791,409 A | | 8/1998 | Flanders | |
| 5,862,870 A | | 1/1999 | Hutchinson | |
| 6,227,313 B1 | | 5/2001 | Davis et al. | |

FOREIGN PATENT DOCUMENTS

| | | |
|---|---|---|
| GB | 2 316 965 A | 3/1998 |
| WO | WO 99/57409 A2 | 11/1999 |
| WO | WO 00/70183 A1 | 11/2000 |

OTHER PUBLICATIONS

Baker Oil Tools Product Catalog; Fishing Services; *Tri–State Model "D" Section Mill, Product No. 150–72*; p. 35.

Baker Oil Tools Product Catalog; Fishing Services; *Lockomatic Section Mill Dressed With Metal Muncher Cutter, Product No. 150–95*; p. 36. (Best Available Copy.).

Baker Oil Tools Product Catalog; Fishing Services; *Multi–String Cutter, Product No. 170–08*; p. 6.

Baker Oil Tools Product Catalog; Fishing Services; *Inside Hydraulic Cutter, Product No. 170–03*; p. 11.

* cited by examiner

*Primary Examiner*—David Bagnell
*Assistant Examiner*—Daniel P. Stephenson
(74) *Attorney, Agent, or Firm*—Gerald W. Spinks

(57) ABSTRACT

A method and apparatus for milling a section of casing in an upward direction, utilizing a downhole hydraulic thrusting mechanism for pulling a section mill upwardly. A downhole motor and torque anchor can be used to rotate the section mill, or the mill can be rotated by a work string. A stabilizer above the section mill can be used to stabilize the mill relative to the casing being milled. A spiral auger below the section mill can be used to move the cuttings downwardly.

16 Claims, 4 Drawing Sheets

REVERSE SECTION MILLING METHOD AND APPARATUS

CROSS REFERENCE TO RELATED APPLICATIONS

This application is a continuation-in-part of co-pending U.S. Ser. No. 09/619,131, filed Jul. 18, 2000, for "Reusable Cutting and Milling Tool", the disclosure of which is incorporated herein by reference. The parent application claimed the benefit of U.S. Provisional Pat. Application No. 60/145,638, filed Jul. 27, 1999, for "Reusable Cutting and Milling Tool". This application also claims the benefit of U.S. Provisional Patent Application No. 60/338,458, filed Nov. 30, 2001, for "Reverse Section Milling Method and Apparatus".

STATEMENT REGARDING FEDERALLY SPONSORED RESEARCH OR DEVELOPMENT

Not Applicable

BACKGROUND OF THE INVENTION

1. Field of the Invention

This invention is in the field of methods and apparatus used to remove a "window" or section of piping from a casing pipe in an oil or gas well.

2. Background Art

Section milling of pipe, that is, removing a section of pipe installed down hole in an oil or gas well, by milling it away, has been known in the art for a long time. However, passing a section milling tool through a smaller diameter pipe in order to section mill a larger diameter pipe farther downhole has always been more difficult, and the known methods have not met with much success. Typically, the procedure has relied upon an attempt to mill the larger diameter pipe from above, proceeding in the downhole direction. In milling downwardly, the weight of the drill string, possibly including drill collars, is used to apply downward force to the mill to cause it to progress through the pipe being milled. This application of force to the mill by weight applied from above creates a wobble in the milling work string, which has a tendency to fracture the cutting inserts on the section mill blades. This, in turn, causes the mill to wear out sooner, resulting in the removal of less pipe footage before replacement of the mill is required. Further, since milling progresses downwardly, cuttings must be removed from the well bore as they are formed, to avoid forming a ball of cuttings around the mill and reducing its effectiveness. Specialized formulation of milling fluid, and maintenance of proper fluid flow rates, are required in order to circulate the cuttings out of the hole.

One example of a situation in which these section milling problems are important is in the resolution of a gas migration problem. Many oil and gas well producers are faced with the problem of wells that have gas migration between casing strings, and this gas may ultimately migrate back uphole to the wellhead system. This leakage could pose a serious problem in that the gas could be ignited, causing a well explosion. Consequently, in the interest of safety, such wells must be repaired. In doing so, it is generally considered necessary to provide a means of removing one or more inner strings of casing pipe, at a location downhole, and exposing an outer string of casing pipe for cementing, to seal off the gas migration path.

As an example, a 16" cased hole may have a 10¾" casing and a 7" casing inside, in a more or less coaxial arrangement.

Gas migration may occur between the 10¾" casing and the 16" casing. Heretofore, the typical repair has been to pilot mill all the 7" and 10¾" casings completely away, from the top, down to a selected location downhole. A packer is then set against the 16" casing, and cement is installed on top of the packer. This is a time consuming and costly endeavor. Further, management of cuttings, cuttings disposal, and milling mud properties all have to be planned for in this program.

BRIEF SUMMARY OF THE INVENTION

The method and apparatus of the present invention provide a better solution to this problem, as described in the following. In a first embodiment, a section mill is used in combination with an up-thruster tool and a downhole motor. The apparatus is tripped into the hole to position the section mill at the lower end of the downhole interval where a window is to be cut. The section mill is at or near the bottom of the apparatus, with a stabilizer, an up-thruster, a mud motor, and an anti-torque anchor positioned above that, in order. A spiral auger with a left hand twist can be positioned below the section mill, to assist in moving the cuttings downhole.

The anti-torque anchor is set against the innermost casing, the mud motor is run, and an upward force is exerted on the section mill with the up-thruster. The casing is cut through, and a portion of the casing is milled out, as the mill progresses upwardly. When the up-thruster reaches its full travel, the apparatus is released and re-set at a higher location, with the mill positioned at the upper end of the milled opening, and with the up-thruster extended. The process is then repeated. After milling of the desired window, other operations through the window can take place, such as cementing.

In a second embodiment, the same type of section mill is used in combination with an up-thruster tool and a rotating work string. The difference between this and the first embodiment is that the mill is rotated by a rotating work string, rather than a downhole motor, and no anti-torque anchor is needed. Here again, a spiral auger with a left hand twist can be positioned below the section mill.

Use of this invention increases the life of the mill, resulting in the milling of more footage with each mill, reducing the number of trips of the work string, and reducing rig costs. In either embodiment, the work string is always in tension while milling. Cuttings can be left down hole, which eliminates the need for special mud and the need for handling and disposing of the cuttings. A relatively constant force is exerted on the cutting blades. Pump pressure is regulated to keep a regulated upward force on the cutter, by means of the up-thruster. Better centralization of the drilling string and the cutter are achieved, with less wobble. Especially in the mud motor embodiment, there is much less wobble in the work string than with downward milling. Where used, the anti-torque tool eliminates back torque and results in a stiffer milling assembly. Drill collars are not needed; smaller pipe and smaller rigs can be used. Coil tubing can even be used in the downhole motor embodiment.

The novel features of this invention, as well as the invention itself, will be best understood from the attached drawings, taken along with the following description, in which similar reference characters refer to similar parts, and in which:

DETAILED DESCRIPTION OF THE INVENTION

Figure 1:
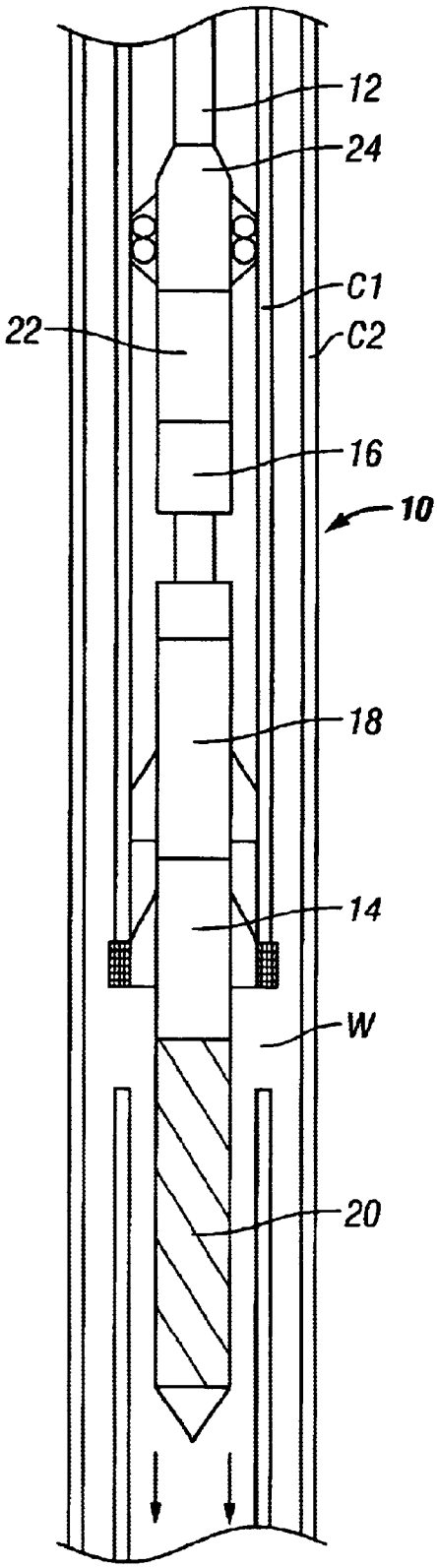
FIG. 1 is a schematic view of a first embodiment of the present invention, employing a downhole motor.
Figure 2:
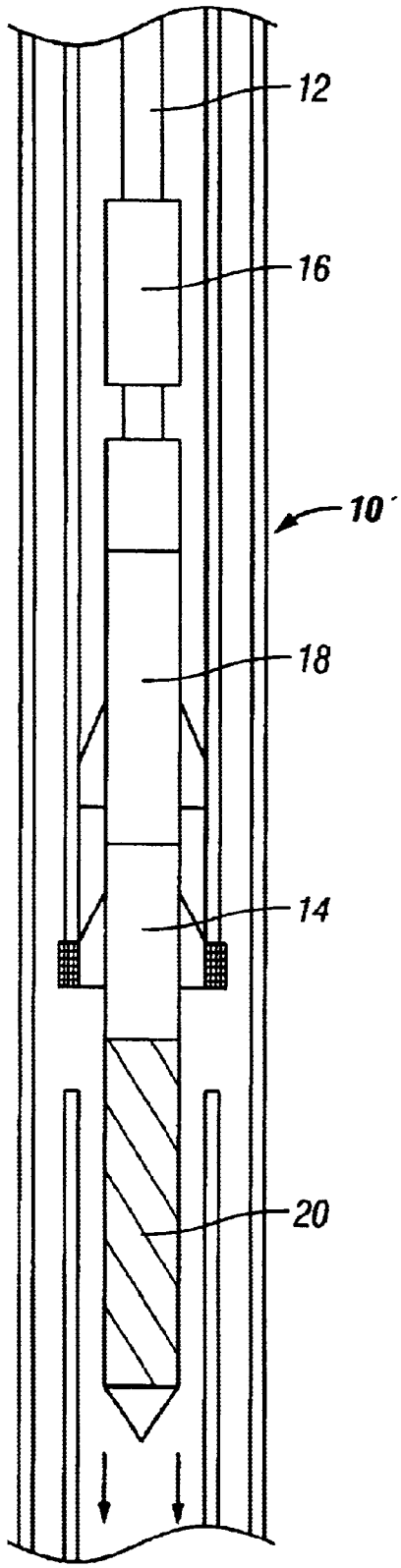
FIG. 2 is a schematic view of a second embodiment of the present invention, employing a rotating work string.

In a first embodiment of the apparatus 10 of the present invention, shown in FIG. 1, a section mill 14 designed for upward milling, in combination with an up-thruster tool 16, an anti-torque tool 24, and a downhole motor 22, are mounted to a work string 12. The apparatus 10 is tripped into the hole to position the section mill 14 at the lower end of the interval where a window W is to be cut. For clarity, FIG. 1 actually shows the apparatus 10 after the inner casing C1 has been cut through, and after the milling of the window W has begun. The section mill 14 is at the bottom of the apparatus 10, with a stabilizer 18, an up-thruster 16, a mud motor 22, and an anti-torque anchor 24 positioned above that, in order. A spiral auger 20 with a left hand twist can be positioned below the section mill 14, to assist in moving the cuttings downhole, as shown by the lower arrows.

Figure 10:
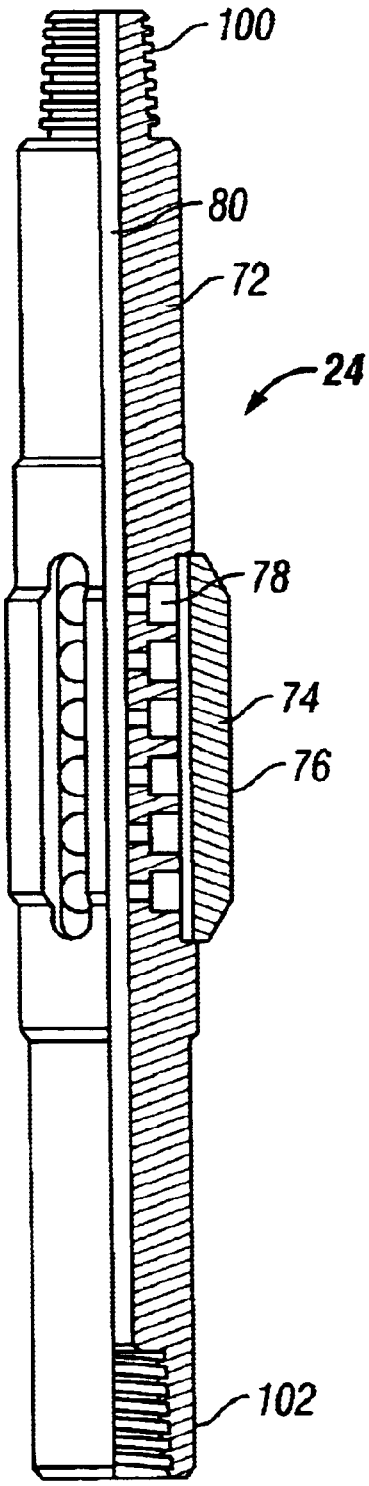
FIG. 10 is a longitudinal section view of a hydraulically actuated anti-torque anchor device which can be used in the present invention.

Torque anchor. A torque anchor 24, better seen in FIG. 10, is run above the up-thruster 16, or lift cylinder, in the mud motor embodiment 10. The upper end 100 of the torque anchor 24 is attached to the work string 12, and the mud motor 22 is attached to the lower end 102 of the torque anchor 24. The torque anchor 24 prevents the drill string 12 from overreacting to the torque generated by the mud motor 22. Often, without the torque anchor 24, the drillstring 12 would torque up and reduce in length as the motor 22 stalls, causing the milling tool blades to quickly degrade. The torque anchor 24 eliminates this condition. The torque anchor 24 is a downhole torque barrier, or anti-torque tool, which engages the wall of the borehole or casing C1 in which it is positioned, with at least one gripping member 74 therein. The gripping member 74 is designed to prevent rotation of the torque barrier 24 relative to the borehole wall or casing wall. The gripping members 74 are preferably hydraulically displaced in a generally outward direction by a plurality of cylinders 78, transverse to the longitudinal axis of the tool 24, until they engage the wall of the borehole or casing. The cylinders 78 are pressurized by fluid from the fluid flow path 80 through the center of the tool. An outwardly facing surface 76 of at least one of the gripping members 74 has gripping contours designed to engage the borehole or casing wall and prevent rotational movement relative thereto, such as teeth, ridges, or ribs. The tool 24 can be actuated by increasing the pressure of fluid being pumped downhole through a fluid flow path 80 in the center of the tool, to displace the gripping members 74 outwardly until they engage the borehole wall or casing. Thereafter, the downhole motor 22 or other downhole rotating tool can be operated, with all of the reactive torque being absorbed by the anti-torque tool 24. This isolates the downhole torque from the work string 12.

Figure 11:
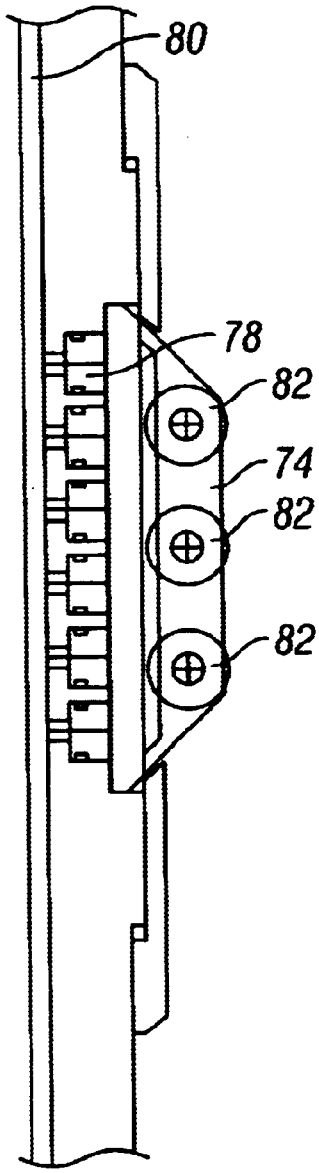
FIG. 11 is a partial section view of one embodiment of an anti-torque blade mechanism which can be employed in the anchor device of FIG. 10.

The gripping members 74 can be configured to allow movement of the anti-torque tool 24 in either longitudinal direction, or only in the uphole direction, to prevent longitudinal movement of the torque anchor 24 during the upward advance of the section mill 14. This can be done by implementing one or more wheels 82, or other rolling devices, in the gripping member 74, as shown in FIG. 11. The rolling device 82 can include a mechanism such as a ratchet to allow longitudinal movement in only the uphole direction. Alternatively, the gripping members 74 can be configured to prevent any longitudinal movement of the torque barrier 24 relative to the borehole or casing wall, as well as preventing rotation of the torque barrier 24 relative thereto. A blade without wheels would be an example of such a longitudinally stationary gripping member 74.

Figure 3:
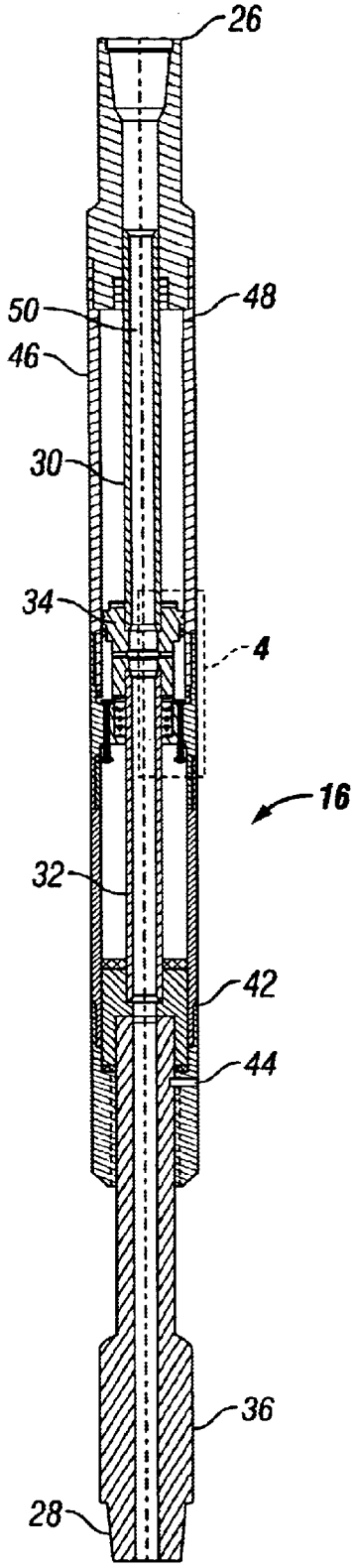
FIG. 3 is a longitudinal section view of a hydraulically actuated up-thruster device which can be used in the present invention.

Up-thruster. The purpose of the up-thruster or lift cylinder 16 is to supply a constant upward load on the section mill 14. If a mud motor 22 were used to drive the mill 14 without the up-thruster 16, the loading imparted by the drilling operator, using the drilling rig to lift the mill 14 and cut into the casing C1, would be too erratic. The operator would have to be extremely careful not to overload the mill 14, otherwise the mud motor 22 would stall out. In a preferred embodiment as shown in FIG. 3, the up-thruster 16 is a hydraulic cylinder pressurized by the mud flow which is pumped through a fluid flow path in the anti-torque anchor 24, the mud motor 22, the up-thruster 16, and on down through the section mill 14. Drilling mud passes through the section mill 14 below the up-thruster 16, as described below, through a flow restriction which creates a back pressure in the apparatus 10. This back pressure is used to cause the up-thruster 16 to lift upwardly on the section mill 14. With a lifting cylinder 16 in the apparatus 10, the pump pressure can be controlled in such a fashion that loading on the mill 14 is very constant, and loading can be imparted with much more precision.

As shown in FIG. 3, the up-thruster 16 is a tensioning device which is attached at its upper end 26 to the lower end of the mud motor 22, and a stabilizer 18 can be attached to the lower end 28 of the up-thruster 16. The up-thruster 16 can include an upper mandrel 30, and an intermediate mandrel 32, with a piston 34 therebetween. A lower mandrel 36 can be joined to the intermediate mandrel 32 by means of a mandrel cap 42, with the lower mandrel 36 protruding in a sliding fashion from the lower end of the housing 46. Initially, the lower mandrel 36 can be pinned to the housing 46 by a shear pin 44, retaining the lower mandrel 36 in its fully extended position. It can be seen that this also results in the fully extended condition of the overall up-thruster 16.

Figure 4:
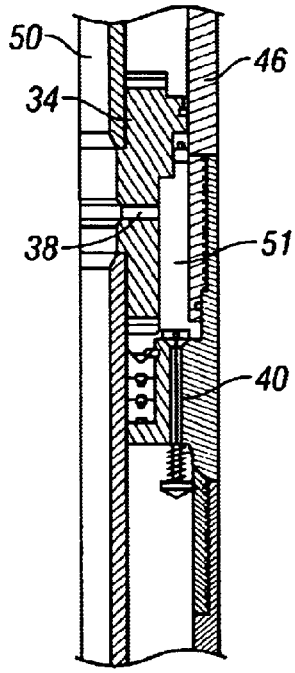
FIG. 4 is a partial section view of a piston and valve mechanism used in the up-thruster device of FIG. 3.

As shown in FIG. 4, the piston 34, along with the mandrels 30, 32, 36, is slidingly mounted within the housing 46, forming an annular hydraulic cylinder 51 between the piston 34 and the housing 46. At least one fluid passage 38 conducts fluid from the fluid flow path 50 near the axis of the tool to the annular cylinder 51, for the purpose of driving the piston 34 and the mandrels 30, 32, 36 upwardly. This can only occur after shearing of the shear pin 44. When the piston 34 is driven upwardly, it can be seen that the lower end 28 of the up-thruster 16 is drawn upwardly toward the upper end 26, and toward the work string 12.

Figure 5:
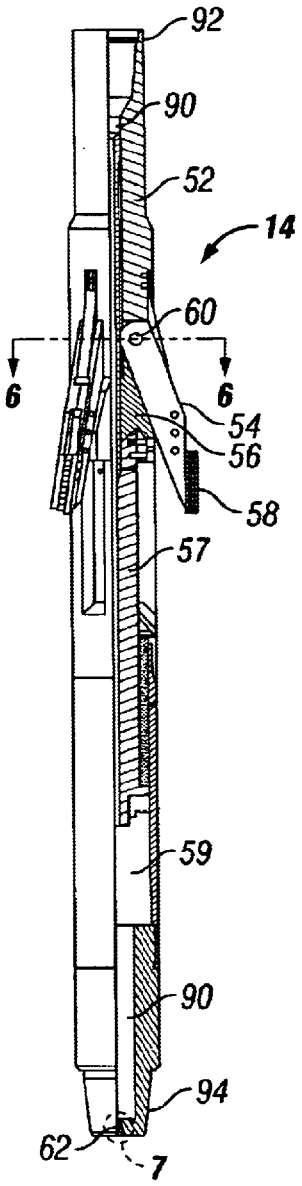
FIG. 5 is a longitudinal section view of a hydraulically actuated section mill which can be used in the present invention.
Figure 6:
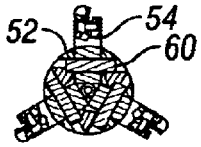
FIG. 6 is a transverse section view of the section mill of FIG. 5, at the plane of the arm pivot points.

Section Mill. The primary design feature of the section mill 14, better seen in FIG. 5, is that the arms 54 are held in the open position by an upward moving wedge block 56 that supports the arms 54 and prevents them from collapsing under heavy loading. The upper end 92 of the section mill 14 is attached to the lower end of the up-thruster 16, via a stabilizer 18 if desired. The section mill 14 used in the present invention has a plurality of pivotable arms 54 mounted in longitudinal slots in a tool body 52. As seen in FIGS. 5 and 6, the arms 54 pivot about pins 60 near the upper ends of the arms 54. A piston 57 below the arms 54, within the tool body 52, is slidably disposed to move the wedge block 56 upwardly against the lower ends and inner sides of the pivotable arms 54. A fluid flow passageway 90 for drilling fluid is provided through the tool body 52 and through the piston 57, to a space 59 within the tool body 52 below the piston 57. Application of fluid pressure to this space 59 below the piston 57 exerts an upward hydraulic force, moving the piston 57 and wedge block 56 upwardly against the arms 54. This upward motion of the piston 57 exerts an upward and outward force against the lower ends of the arms 54, thereby exerting a maximized outward force on the blades 58 on the outer surfaces of the arms 54. Alternatively, the piston 57 and arm 54 can have an angled slot-and-pin mechanism (not shown) which exerts this upward and outward force. Further alternatively, the piston 57 can have a pin or roller (not shown) which engages the lower edge and the inner edge of the arm 54 at an angle.

The piston 57 can have a fluid inlet port through which the drilling fluid flows to reach the space 59 below the piston 57. A ball or other closure member can be pumped downhole with the drilling fluid to close this fluid inlet port, resulting in the subsequent application of downward hydraulic pressure against the piston 57, driving it downwardly. Alternatively, a spring can be arranged to drive the piston 57 downwardly, and the arms 54 inwardly, upon release of hydraulic pressure. Downward driving of the piston 57 can be used to retract the arms 54 and the blades 58.

Figure 7:
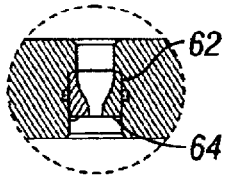
FIG. 7 is a partial section view of a nozzle which can be used in the outflow of the fluid flow path in the section mill of FIG. 5.

A fluid outlet port can be provided in the lower end of the tool body 52, below the piston 57. A nozzle 62 can be mounted in this port in the lower end 94 of the body 52, as seen in FIGS. 5 and 7. The nozzle 62 can be sized to create the desired backpressure in the drilling fluid system.

The section mill arm 54 can be fitted with a casing cutter type blade (not shown), for penetration of a casing, or the arm 54 can be fitted with the square type blades 58 typically found on a pilot mill, to provide for milling an extended length of casing. The section mill 14 can first be operated to penetrate the casing with the casing cutter type blade, then the arms 54 can be exchanged for arms 54 having the pilot mill type blades 58, for the remainder of the procedure.

Figure 8:
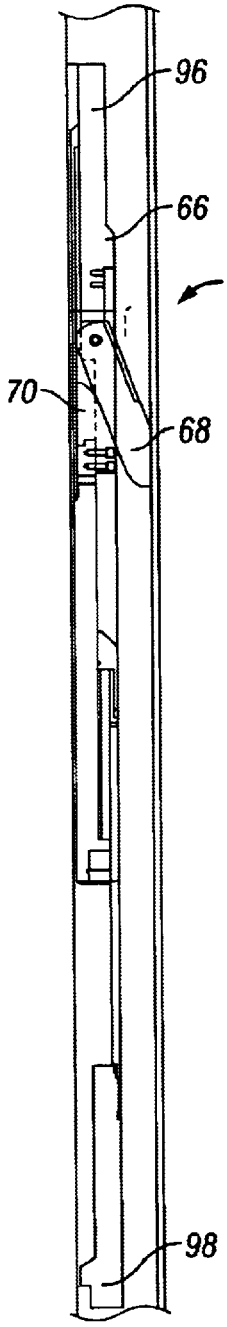
FIG. 8 is a longitudinal section view of a hydraulically actuated stabilizer which can be used in the present invention, with the stabilizer arms extended.
Figure 9:
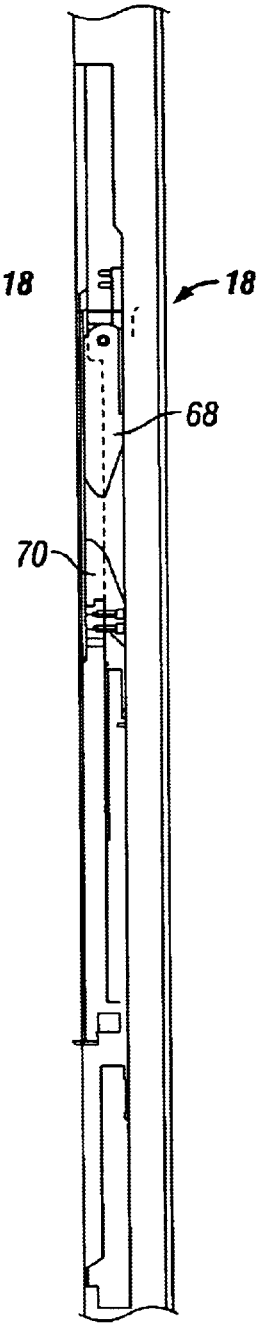
FIG. 9 is a longitudinal section view of the hydraulically actuated stabilizer of FIG. 8, with the stabilizer arms retracted.

Stabilizer. An expandable stabilizer 18 is used to stabilize the mill 14 once it has passed through a smaller casing C1, such as the 7" casing, if milling of a larger casing C2, such as the 10¾" casing, is needed. Basically, the stabilizer 18 is identical to the section mill 14, except that the arms 68 are dressed with hard facing material, to the size of the casing inner diameter. The arms 68 pivot about pins in the stabilizer housing 66, when driven by a wedge block 70. Extension and retraction of the arms 68 of the stabilizer 18 are shown in FIGS. 8 and 9, respectively. When the stabilizer 18 is used, the upper end 96 of the stabilizer 18 can be attached to the lower end of the up-thruster 16, and its lower end 98 can be attached to the upper end of the section mill 14.

Spiral Auger. The spiral auger 20 is simply a short drill collar dressed with aggressive left hand spiraled ribs. The ribs tend to force or auger the cuttings to the bottom of the well, as shown by the arrows, moving them away from the cutter blades 58, and preventing the cuttings from balling up around the mill 14.

In a second embodiment of the apparatus 10', the same type of section mill 14, designed for upward milling, is used in combination with an up-thruster tool 16 and a rotating work string 12. The apparatus 10' is tripped into the hole to position the section mill 14 at the lower end of the interval where a window W is to be cut. The section mill 14 is at or near the bottom of the apparatus 10', with a stabilizer 18 and an up-thruster 16 positioned above that, in order. A spiral auger 20 with a left hand twist can be positioned below the section mill 14, to assist in moving the cuttings downhole.

Method of Operation

The anti-torque anchor 24 is set against the innermost casing C1 as the milling fluid pressure is increased, which also starts the mud motor 22 running and exerts an upward force on the section mill 14 with the up-thruster 16. Fluid pressure extends the arms 54 and blades of the mill 14, and the mill 14 is rotated by the downhole motor 22. The torque anchor 24, mud motor 22, up-thruster 16, stabilizer 18, and section mill 14 can have the sizes and shapes of their fluid flow paths designed to initiate their respective operations at selected progressive pressure levels, to insure the desired sequence of activation of the various tools. The section mill 14 can be set to extend its arms 54 at a relatively low pressure, so that the arms 54 will extend before the up-thruster 16 begins to lift the arms 54 into cutting contact with the casing. Additionally, the motor 22 can be designed to bypass fluid before it begins to rotate. As a result, the cutter arms 54 extend, then the torque anchor blades 74 contact the casing wall, then the mud motor 22 begins to rotate, and finally, the up-thruster 16 begins to lift the section mill 14. On the first cut, the casing is cut through, and then a portion of the 7" casing is milled out, until the up-thruster 16 reaches its full travel, or "bottoms out". This opens the piston valves 40, and a pressure drop will be noted in the milling fluid at this time.

Then, the milling fluid pressure is reduced, to stop rotation of the mud motor 22, release the anti-torque tool 24, retract the mill arms 54, and allow the up-thruster 16 to extend to its original length. The work string 12 is then lifted to raise the section mill 14 until its arms 54 are positioned next to the milled lower end of the 7" casing, at the top of the window W. Pressure is then increased to extend the mill arms 54, reset the anti-torque anchor 24, rotate the mud motor 22, apply upward pressure to the mill 14, and resume milling. This process is then repeated as required. In this way, a window W of desired length, for example, 250 feet, is cut out of the 7" casing. Use of this method insures that the drill pipe is held in tension at all times, thereby eliminating wobble in the work string 12. Pump pressure is regulated to keep a regulated upward force on the cutters 58, by means of the up-thruster 16. Cuttings can also be dropped down hole, since milling is moving in the upward direction, eliminating the necessity to circulate the cuttings out of the hole. The procedure is continued until milling of the desired section length is complete, or until new cutting blades are needed.

When the rotating work string is used, the anti-torque anchor 24 and mud motor 22 are not used, so rotation of the section mill 14 is accomplished by rotation of the work string and the other components. Otherwise, the procedure is essentially the same.

In the example given earlier, a suitable underreamer is then installed to remove the cement from the window W, out to the inside diameter of the 10¾" casing C2. A larger section mill 14 and anchor 24 can then be installed, and the process can be repeated to remove a shorter section, for example, 150 feet, of the 10¾" casing. The lower end of the 150 foot window in the 10¾" casing is preferably located at the lower end of the 250 foot window in the 7" casing. After removal of the cement in the 150 foot window, out to the inside diameter of the 16" casing, an inflatable packer (not shown) is set at the lowest point where the 16" casing has been exposed and cleaned of cement. Once set, the packer is then covered with approximately 100 feet of cement. This effectively stops the gas migration in the well.

While the particular invention as herein shown and disclosed in detail is fully capable of obtaining the objects and providing the advantages hereinbefore stated, it is to be understood that this disclosure is merely illustrative of the presently preferred embodiments of the invention and that no limitations are intended other than as described in the appended claims.

We claim:

1. A section milling apparatus for milling of a downhole portion of casing in a well, comprising:

a work string;

a hydraulic tensioning device having an upper end and a lower end, said upper end being attachable to said work string, said tensioning device being adapted to selectively pull said lower end upwardly toward said work string;

a section mill mountable in said section milling apparatus below said lower end of said hydraulic tensioning device, said section mill having a plurality of arms adapted to pivot outwardly and upwardly, said section mill being adapted to hydraulically apply an upward force to pivot said arms outwardly to contact a casing in a cutting relationship; and a fluid flow path through said work string, said fluid flow path being adapted to supply hydraulic pressure to operate said hydraulic tensioning device, and to pivot said arms of said section mill;

wherein said section mill is adapted to expand at a lower fluid pressure than a fluid pressure at which said hydraulic tensioning device is adapted to pull upwardly.

2. The section milling apparatus recited in claim 1, further comprising a hydraulically expandable stabilizer mountable in said section milling apparatus between said hydraulic tensioning device and said section mill;

wherein said stabilizer is adapted to hydraulically extend a plurality of stabilizer blades, to stabilize said section milling apparatus relative to a casing to be milled by said section mill; and wherein said stabilizer is adapted to expand at a lower fluid pressure than said fluid pressure at which said hydraulic tensioning device is adapted to pull upwardly.

3. The section milling apparatus recited in claim 1, further comprising a spiral auger mountable in said section milling apparatus below said section mill, said spiral auger being fitted with spiral ribs, said spiral ribs being adapted to move cuttings downhole as said spiral auger rotates in an angular direction opposite to the angular direction in which said ribs are spiraled.

4. The section milling apparatus recited in claim 1, further comprising:

a fluid driven downhole motor mountable in said section milling apparatus above said hydraulic tensioning device; and a hydraulically operable anti-torque anchor mountable in said section milling apparatus above said fluid driven motor and below said work string, said anti-torque anchor being adapted to hydraulically expand into contact with a casing to be cut by said section mill, to prevent transmission of torque up said work string during operation of said fluid driven motor;

wherein said anti-torque anchor is adapted to expand at a fluid pressure which is higher than said fluid pressure at which said section mill is adapted to expand, but lower than said fluid pressure at which said hydraulic tensioning device is adapted to pull upwardly; and wherein said fluid driven motor is adapted to begin to rotate at a fluid pressure which is higher than said fluid pressure at which said anti-torque anchor is adapted to expand, but lower than said fluid pressure at which said hydraulic tensioning device is adapted to pull upwardly.

5. A section milling apparatus for milling of a downhole portion of casing in a well, comprising:

a rotatable work string;

a hydraulic tensioning device having an upper end and a lower end, said upper end being attachable to said work string, said tensioning device being adapted to selectively pull said lower end upwardly toward said work string;

a section mill attachable to said lower end of said hydraulic tensioning device for rotation by rotation of said work string, said section mill having a plurality of arms adapted to pivot outwardly and upwardly, said section mill being adapted to hydraulically apply an upward force to pivot said arms outwardly to contact a casing in a cutting relationship; and a fluid flow path through said work string, said fluid flow path being adapted to supply hydraulic pressure to operate said hydraulic tensioning device, and to pivot said arms of said section mill;

wherein said section mill is adapted to expand at a fluid pressure which is lower than a fluid pressure at which said hydraulic tensioning device is adapted to pull upwardly.

6. The section milling apparatus recited in claim 5, further comprising a hydraulically expandable stabilizer mountable in said section milling apparatus between said hydraulic tensioning device and said section mill;

wherein said stabilizer is adapted to hydraulically extend a plurality of stabilizer blades, to stabilize said section milling apparatus relative to a casing to be milled by said section mill; and wherein said stabilizer is adapted to expand at a lower fluid pressure than said fluid pressure at which said hydraulic tensioning device is adapted to pull upwardly.

7. The section milling apparatus recited in claim 5, further comprising a spiral auger mountable in said section milling apparatus below said section mill, said spiral auger being fitted with spiral ribs, said spiral ribs being adapted to move cuttings downhole as said spiral auger rotates in an angular direction opposite to the angular direction in which said ribs are spiraled.

8. A section milling apparatus for milling of a downhole portion of casing in a well, comprising:

a work string;

a hydraulic tensioning device having an upper end and a lower end, said upper end being attachable to said work string, said tensioning device being adapted to selectively pull said lower end upwardly toward said work string;

a section mill attachable to said lower end of said hydraulic tensioning device, said section mill having a plurality of arms adapted to pivot outwardly and upwardly, said section mill being adapted to hydraulically apply an upward force to pivot said arms outwardly to contact a casing in a cutting relationship;

a fluid driven downhole motor mountable in said section milling apparatus above said hydraulic tensioning device;

a hydraulically operable anti-torque anchor mountable in said section milling apparatus above said fluid driven motor and below said work string, said anti-torque anchor being adapted to expand into contact with a casing to be cut by said section mill, to prevent transmission of torque up said work string during operation of said fluid driven motor; and a fluid flow path through said work string, said fluid flow path being adapted to supply hydraulic pressure to operate said hydraulic tensioning device, to pivot said arms of said section mill, to rotate said fluid driven motor, and to expand said anti-torque anchor;

wherein said section mill is adapted to expand at a fluid pressure which is lower than a fluid pressure at which said hydraulic tensioning device is adapted to pull upwardly;

wherein said anti-torque anchor is adapted to expand at a fluid pressure which is higher than said fluid pressure at which said section mill is adapted to expand, but lower than said fluid pressure at which said hydraulic tensioning device is adapted to pull upwardly; and wherein said fluid driven motor is adapted to begin to rotate at a fluid pressure which is higher than said fluid pressure at which said anti-torque anchor is adapted to expand, but lower than said fluid pressure at which said hydraulic tensioning device is adapted to pull upwardly.

9. The section milling apparatus recited in claim 8, further comprising a hydraulically expandable stabilizer mountable in said section milling apparatus between said hydraulic tensioning device and said section mill;

wherein said stabilizer is adapted to hydraulically extend a plurality of stabilizer blades, to stabilize said section milling apparatus relative to a casing to be milled by said section mill; and wherein said stabilizer is adapted to expand at a lower fluid pressure than said fluid pressure at which said hydraulic tensioning device is adapted to pull upwardly.

10. The section milling apparatus recited in claim 8, further comprising a spiral auger mountable in said section milling apparatus below said section mill, said spiral auger being fitted with spiral ribs, said spiral ribs being adapted to move cuttings downhole as said spiral auger rotates in an angular direction opposite to the angular direction in which said ribs are spiraled.

11. A method for section milling of a downhole portion of casing in a well, comprising:

providing a work string, with a section mill and a hydraulic tensioning device attached thereto, said section mill being attached below a lower end of said tensioning device;

lowering said work string, said section mill, and said tensioning device into a casing to be milled;

pumping fluid through said work string to supply hydraulic pressure to said hydraulic tensioning device and said section mill;

raising said hydraulic pressure to a first level at which an upward force is hydraulically applied within said section mill, to cause a plurality of arms on said section mill to pivot outwardly and upwardly to contact said casing in a cutting relationship;

rotating said section mill to cut through said casing;

raising said hydraulic pressure to a second level, higher than said first level, at which a lower end of said tensioning device is hydraulically pulled upwardly toward said work string, thereby pulling said section mill upwardly; and rotating said section mill to mill a window in said casing in an upward direction.

12. The method recited in claim 11, further comprising:

providing a hydraulically expandable stabilizer mounted between said hydraulic tensioning device and said section mill; and hydraulically extending a plurality of stabilizer blades on said stabilizer, to stabilize said section milling apparatus relative to said casing;

wherein said stabilizer expansion is accomplished at a lower fluid pressure than said fluid pressure at which said hydraulic tensioning device pulls upwardly.

13. The method recited in claim 11, further comprising:

providing a spiral auger mounted below said section mill, said spiral auger being fitted with spiral ribs; and rotating said spiral auger in an angular direction opposite to the angular direction in which said ribs are spiraled, to move cuttings downhole.

14. The method recited in claim 11, further comprising:

providing a fluid driven downhole motor mounted above said hydraulic tensioning device and a hydraulically operable anti-torque anchor mounted above said fluid driven motor and below said work string;

hydraulically expanding said anti-torque anchor into contact with said casing, to prevent transmission of torque up said work string during operation of said fluid driven motor;

wherein said anti-torque anchor expansion is accomplished at a fluid pressure which is higher than said fluid pressure at which said section mill expands, but lower than said fluid pressure at which said hydraulic tensioning device pulls upwardly; and rotating said fluid driven motor to accomplish said rotation of said section mill;

wherein said fluid driven motor begins to rotate at a fluid pressure which is higher than said fluid pressure at which said anti-torque anchor expands, but lower than said fluid pressure at which said hydraulic tensioning device pulls upwardly.

15. The method recited in claim 11, further comprising rotating said section mill by rotation of said work string.

16. The method recited in claim 11, further comprising:

stopping rotation of said section mill;

lowering hydraulic pressure to allow said hydraulic tensioning device to extend to its original length, and to allow said section mill to retract said plurality of arms;

raising said work string to raise said section mill to a position adjacent an upper end of said window milled in said casing;

returning said hydraulic pressure to said first level at which an upward force is again hydraulically applied within said section mill, to cause said plurality of arms on said section mill to pivot outwardly and upwardly to resume contact with said casing at said upper end of said window;

returning said hydraulic pressure to said second level at which said lower end of said tensioning device is again hydraulically pulled upwardly toward said work string, thereby pulling said section mill upwardly; and resuming rotation of said section mill to resume milling said window in said casing in an upward direction.

* * * * *